United States Patent [19]

Ezaki et al.

[11] Patent Number: 4,874,171

[45] Date of Patent: Oct. 17, 1989

[54] GOLF CLUB SET

[75] Inventors: Hiroshi Ezaki; Yoneji Kobayashi; Katsumi Iida, all of Tokyo, Japan

[73] Assignee: Bridgestone Corporation, Tokyo, Japan

[21] Appl. No.: 95,281

[22] Filed: Sep. 10, 1987

[30] Foreign Application Priority Data

Sep. 12, 1986 [JP] Japan ..... 61-215081

[51] Int. Cl.[4] ..... A63B 53/00; A63B 53/04

[52] U.S. Cl. ..... 273/77 A; 273/167 H; 273/169; 273/172; 273/174

[58] Field of Search ..... 273/167 H, 169, 171, 273/172, 174, 77 A

[56] References Cited

U.S. PATENT DOCUMENTS

| | | | |
|---|---|---|---|
| 3,984,103 | 10/1976 | Nix | 273/77 A |
| 4,322,083 | 3/1982 | Imai | 273/167 F |
| 4,451,042 | 5/1984 | Hayashi et al. | 273/171 |
| 4,614,627 | 9/1986 | Curtis et al. | 273/167 H |
| 4,630,827 | 12/1986 | Yoneyama | 273/169 |
| 4,645,207 | 2/1987 | Teramoto et al. | 273/77 A |
| 4,699,383 | 3/1986 | Kobayashi | 273/173 X |
| 4,714,577 | 12/1989 | Nagamoto et al. | 273/167 H X |
| 4,730,830 | 3/1988 | Tilley | 273/171 |
| 4,754,969 | 7/1988 | Kobayashi | 273/77 A |
| 4,784,390 | 11/1988 | Horgen | 273/77 A |

*Primary Examiner*—Carl D. Price

*Attorney, Agent, or Firm*—Jordan and Hamburg

[57] ABSTRACT

The golf club set according to the present invention consists of plural golf clubs of which the lofts are increased iron a predetermined order, preferably with increments of 3° to 4°. The heads of golf clubs with lofts ranging from 9° to 25° in the set being constructed with a sole plate attached to a shell of a synthetic resin and integrally formed with a core, the heads of golf clubs with lofts ranging from 22° to 31° being constructed with a shell of a synthetic resin, core and sole plate formed integrally with one another, and the heads of golf clubs with lofts ranging from 28° to 50° being constructed with a mass of a high specific gravity synthetic resin and a sole plate molded integrally with each other.

3 Claims, 2 Drawing Sheets

GOLF CLUB SET

BACKGROUND OF THE INVENTION

1. Field of the invention

The present invention relates to a golf club set comprising plural golf clubs of which the lofts are increased in a predetermined order.

2. Description of the Prior Art

Generally, each of the conventional golf club sets consists of a set of wood clubs and a set of iron clubs. The set of woods includes usually five kinds numbered 1 to 5, while the set of irons generally contains seven kinds numbered 3 to 9 and two kinds of utility irons, called wedges (pitching and sand wedges) as well (namely, 9 kinds of irons in total). Generally, these clubs in a set differ from one another in length, loft, lie, head weight, depth of center of gravity, sole area, moment of inertia around the head's center of gravity and flexure of shaft, and the player selects an optimum one of the clubs in his set according to his intended trajectory and carry of the ball he is going to strike with the club. The wood clubs in a set are of a same structure and made of a same material, and the iron clubs in a set are also of a same structure and made of a same material.

The important factors on which the carry and trajectory of a struck ball depend are the height and depth of the center of gravity of the club head. It is generally considered that the ball can be easily propelled higher when struck with a club of which the center of gravity is low, and the ball can be more easily spinned when hit with a club having a deeper center of gravity, also resulting in a high flight of the ball. However, the golf club set consisting of the conventional woods in a set which are of a same structure and made of a same material, combined with irons in a set also of a same structure and material has a gap in depth and height of the center of gravity between these sets so that there is a gap in carry and trajectory of the ball between the sets. The reference numeral 100 in FIGS. 8 to 11 indicate the curves representative of the relations between the depth of the club head's center of gravity and the angle of club face's loft, the height of the center of gravity and the angle of loft, the carry of a struck ball and the angle of loft, and between the angles of elevation and loft, respectively, of the conventional set of wood clubs and the reference numeral 101 indicate such curves of the conventional set of iron clubs. As apparent from these curves, there is a gap or discontinuity between the sets of woods and irons.

SUMMARY OF THE INVENTION

The present invention has an object to provide a set of golf clubs, from a driver to pitching wedge, which provide a carry of the ball struck with these clubs over a distance which is decreased in order and along a trajectory of which the height is increased in order.

The above object can be attained by a golf club set, according to the present invention, consisting of plural golf clubs of which the lofts are increased in a predetermined order, preferably with increments of 3° to 4°, the heads of golf clubs with lofts ranging from 9° to 25° being constructed with a sole plate attached to a shell of a synthetic resin and integrally formed with a core, the heads of golf clubs with lofts ranging from 22° to 31° being constructed with a shell of a synthetic resin, core and sole plate formed integrally with one another, and the head of golf clubs with lofts ranging from 28° to 50° being constructed with a mass of a high specific gravity synthetic resin and a sole plate molded integrally with each other.

The golf club set according to the present invention shows no gap in carry and trajectory of the struck ball between the iron and wood sets, and with this golf club set, the carry of the ball is decreased in order from the driver to the pitching wedge and the height of the trajectory of the ball is increased in order from the driver to the pitching wedge. As shown in FIGS. 8 and 9, there is no gap in depth and height of the center of gravity between the wood and iron sets and so the curves 10 representative of the relations between the depth of center of gravity and the loft, and also between the height of center of gravity and the loft which are indicated with the numeral 10, result as shown in FIGS. 8 and 9. Thus, the carry of the ball struck with these wood and iron sets is decreased in order and the trajectory height of the ball is increased in order, as shown by the curves 20 in FIGS. 10 and 11, respectively. According to the present invention, the height of club head's center of gravity can be made smaller and changed smoothly and also the depth of club head's center of gravity can be made larger and changed smoothly. Therefore, the good results could be obtained as shown in FIGS. 10 and 11.

These and other objects and advantages of the present invention will be better understood from the ensuing description made by way of example of the embodiments according to the present invention with reference to the drawings:

DETAILED DESCRIPTION OF THE PREFERRED EMBODIMENTS

Figure 1:
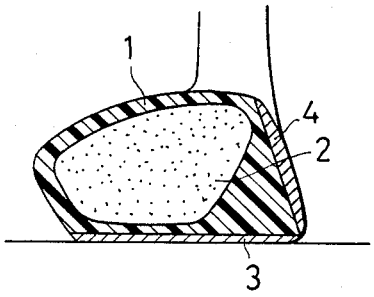
FIG. 1 is a sectional view showing the structure of a golf club head with a loft involved in a range of 9° to 25°.

The head of golf club shown in FIG. 1 is one of the clubs numbered 1 to 4 of which the loft is involved in a range of 9° to 25°. This head has a structure consisting of a shell 1 made of a synthetic resin material and a core or filled cavity 2, which are molded integrally with each other, and to which a sole plate 3 made of a metallic material is attached after the integral molding of the shell and core. The head has also a face 4 which is formed as inserted during the integral molding of the shell and core. The reinforcing fiber used in the face 4 should desirably be longer than 1 inch, and more preferably it should optimally be a pre-preg of carbon fabric in which a resin is impregnated and which has a wf (fiber content by weight) adjusted to 40 to 75%. The carbon fiber used in the face 4 is of a high strength type. For example, a carbon fiber of polyacrylonitrile may be optimally used for this purpose. According to the present invention, the synthetic resin material of the shell 1 is a carbon fiber reinforced resin, the material of the core 2 is a rigid urethane foam and the sole plate 3 is made of a stainless steel. As one example of the molding of the club head shown in FIG. 1, a shell is first molded in which no core 2 is put and which is opened at the top, and the face 4 is formed as inserted during the molding of this shell 1. More particularly, a synthetic resin is poured into the upper and lower split molds, for example, the molds are closed, and the resin is pressurized as heated. During this molding, the face 4 is formed as inserted. A prepreg of any selected carbon fabric in which a resin is impregnated and which has a wf adjusted to 40 to 75% is usable for forming the face 4. In case wf is smaller than 40%, only the resin flows during the molding, causing a poor appearance. When wf is larger than 75%, the resin is not uniformly impregnated in the carbon fabric, causing disadvantages such as poor appearance and degraded impact resistance. By using a variety of fabrics, different patterns can be formed on the surface of the club head thus molded. For forming the shell, SMC (sheet molding compound), for example, is usable. This SMC should desirably contain carbon fiber having a wf adjusted to 25 to 60%. The length of carbon fibers and the number of bound fibers may be arbitrarily selected. These pre-preg and SMC may be used in any selected positions within the club head.

By selecting the positions where they are used, the appearance (pattern) of the head itself can be arbitrarily designed. After a shell in which a face is inserted is molded, it is set in a foaming mold and a lightweight resin material is expanded within the inner space of the shell to form a core 2 which fills the shell inner space. For forming the core 2, for example, a so called master batch consisting of 100 parts by weight of polyol, one part by weight of foam stabilizer, 0.5 part by weight of catalyst and 0.5 part by weight of water is mixed with a hardener (112 parts by weight) for about 15 seconds, the mixture is poured into foaming mold having previously been heated to about 50° C., and further it is hardened in 15 to 20 minutes in an oven, at 50° C. The core 2 thus foamed and molded had a specific gravity of less than 0.6, preferably about 0.25 to 0.50. Next, a molding material of the main portion of the head (portion covering the outer circumference of the shell 1 along with the face 4) is set on the core 2 in the lower one of the upper and lower split molds, and formed as pressed in both the molds. As the molding material, a vinylester (containing thickener and peroxide catalyst) of 50 to 70% by weight in which carbon fiber of which the length is less than 1 inch is mixed in 30 to 50% by weight was used. Therefore, the shell is covered by the face 4 and the main portion molded from the molding material, both being molded from resin materials, respectively, containing reinforcing fibers of which the lengths are more than 1 inch and less than 1 inch, respectively. Also, the carbon fiber used to form this main portion of the golf club should desirably be of a high strength type, and according to the present invention, reinforcing fiber of which the filaments count 6,000 in number and of which the filament diameter is 7 microns was used. Finally, a metal piece of a higher specific gravity selected according to the weight of the head was inserted into the weight adjusting boss hole and a side sole and sole plate were attached to the head in a known manner to finish a golf club head.

Figure 2:
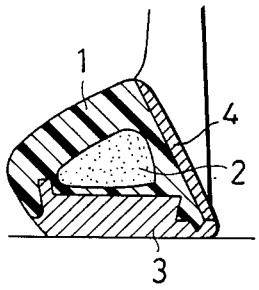
FIG. 2 is also a sectional view showing the structure of a golf club head with a loft ranging from 22° to 31°.
Figure 3:
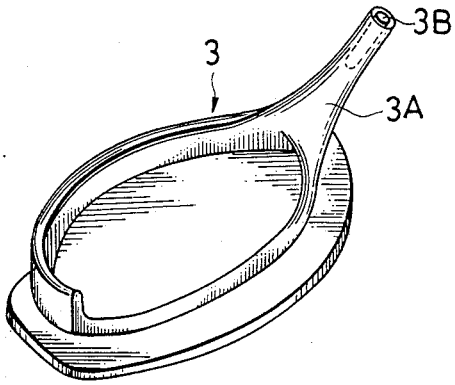
FIG. 3 is a perspective view of a sole plate 3 used with the club head shown in FIG. 2.
Figure 4:
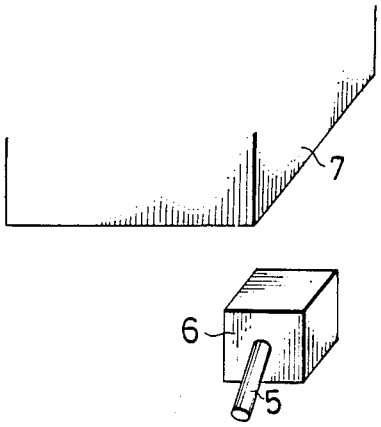
FIG. 4 is also a perspective view showing one example of a means of molding the head shown in FIG. 2.

The club head shown in FIG. 2 is intended for the clubs numbered 5 and 6 and of which the lofts are involved in a range of 22° to 31°. The shell 1 of this head is a carbon fiber reinforced resin, the core 2 is made of a rigid urethane foam and the sole plate 3 is of a stainless steel. The sole plate 3 is integrally formed with the core 2 and shell 1. During this integral forming, the face 4 is formed as inserted similarly to the head shown in FIG. 1. The sole plate 3 of the head shown in FIG. 2 has a joint portion 3A to be connected to the club shaft as shown in FIG. 3. The joint portion 3A has a cylindrical recess 3B formed therein. To mold the head shown in FIG. 2, a moving mold 6 having the shaft 5, upper mold 7 with a cavity formed therein and a lower mold 8 having a cavity in which the sole plate 3 is positioned are used as shown in FIG. 4. The sole plate 3 having been subjected to a predetermined treatment is set in the lower mold 8, the shaft 5 of the moving mold 6 is inserted into the cylindrical recess 3B and set in the lower mold 8. Then SMC (sheet molding compound of 1.3 to 1.8 in specific gravity) is wound a predetermined number of turns on the core 2. Then, a necessary number of SMC layers is stacked on the core and a reinforcing fabric in which a resin is impregnated is also placed on the outermost SMC layer as necessary. This is set on the sole plate 3. Next, the upper and lower molds 7 and 8 are closed together, and heated and pressurized at 125° to 145° C. for 5 to 12 minutes. Thus, the resin component of the SMC is softened once and flows along the shape of the cavities in the molds. Then the resin is hardened to form a head of a predetermined shape.

Figure 5:
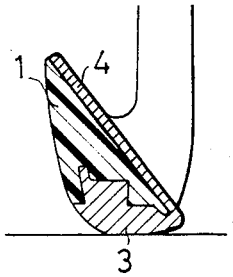
FIG. 5 is a sectional view showing the structure of a golf club head with a loft involved in a range of 28° to 50°.
Figure 5:
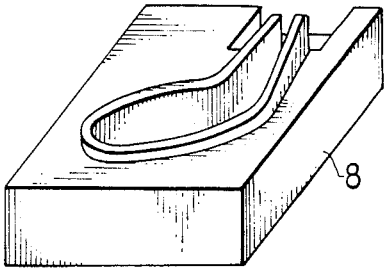

The golf club head shown in FIG. 5 is used as golf clubs numbered 7 to 12. The head shown in FIG. 5 uses no core. This head is a combination of a mass 1 of a synthetic resin containing reinforcing fiber and a sole plate 3 made of a metallic material, which are integrally molded. The material of the mass 1 has a specific gravity of 2.0 to 4.0. The mass 1 should have a sufficient bending strength to bear the impact by the club head when striking the golf ball. To this end, use of carbon fiber as reinforcing fiber is effective, and also it is possible to use alamide or glass fiber for adjustment of the specific gravity. The synthetic resin material of the mass 1 contains a high specific gravity powder such as metal powder such as tungsten, tungsten carbide or brass powder.

A set of golf clubs having the heads described in the foregoing is produced as shown in Table. The #1 in Table corresponds to the driver, and #12 to the pitching wedge. The heads of the clubs numbered 1 to 4 consist of a shell of carbon fiber reinforced resin and a core of rigid urethane foam, which are integrally molded, and also a sole plate of stainless steel which is attached after the integral molding. The heads of clubs numbered 5 and 6 consist of a shell of carbon fiber reinforced resin, core of rigid urethane foam and a sole plate of stainless steel, which are formed integrally. The heads of clubs numbered 7 to 12 consist of a mass of carbon fiber reinforced resin containing tungsten powder and a sole plate of stainless steel, which are integrally formed.

TABLE

| | #1 | #2 | #3 | #4 | #5 | #6 | #7 | #8 | #9 | #10 | #11 | #12 |
|---|---|---|---|---|---|---|---|---|---|---|---|---|
| Lie (deg.) | 56 | 57 | 57.5 | 58 | 58.5 | 59 | 59.5 | 60 | 61 | 62 | 63 | 63 |
| Loft (deg.) | 12 | 16 | 19 | 22 | 25 | 28 | 31 | 34 | 38 | 42 | 46 | 50 |
| Club length (cm) | 109 | 107 | 105 | 103 | 101 | 99 | 97 | 95 | 93 | 91 | 89 | 89 |
| Head Weight (g) | 198 | 205 | 212 | 219 | 230 | 238.5 | 246 | 254.5 | 264 | 275 | 285 | 285 |
| Head volume (cm) | 198 | 146 | 131 | 126 | 110 | 98 | 80 | 62 | 54 | 55 | 57 | 56 |
| Specific gravity (g/cm) | 1.00 | 1.40 | 1.62 | 1.74 | 2.09 | 2.43 | 3.08 | 4.10 | 4.89 | 5.00 | 5.00 | 5.09 |

Figure 6:
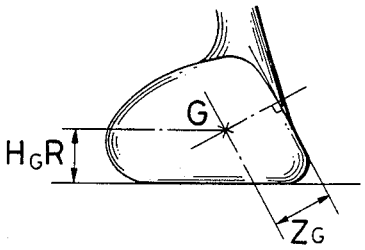
FIG. 6 and 7 are graphs explanative of the depth and height, respectively, of the club head's center of gravity.
Figure 7:
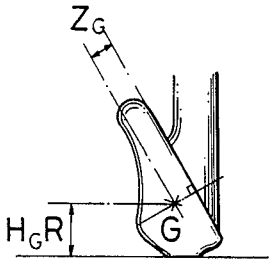
Figure 8:
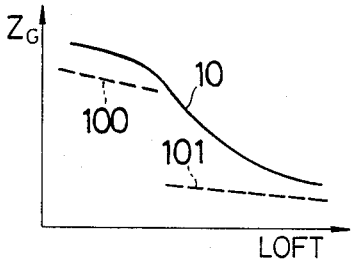
FIG. 8 graphically shows the relation between the height of club head's center of gravity and the loft of club face.
Figure 9:
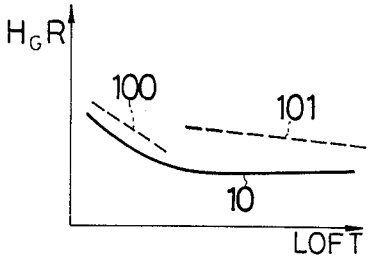
FIG. 9 graphically shows the relation between the depth of club head's center of gravity and the loft of club face.
Figure 10:
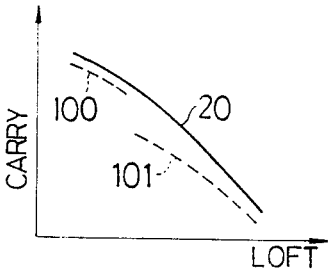
FIG. 10 graphically shows the relation between the carry of the ball struck with the golf clubs and the loft of club face.
Figure 11:
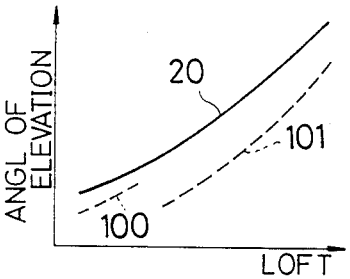
FIG. 11 graphically shows the relation between the angle of elevation of the ball struck with the golf clubs and the loft of club face.

FIGS. 6 and 7 explain the depth and height, respectively, of center of gravity. In FIGS. 6 and 7, G indicates the center of gravity. $Z_G$ the depth of the center of gravity and $H_G$R the height of the center of gravity.

What is claimed is:

1. A golf club set comprising first, second and third groups of golf clubs, each of the clubs in the set comprising a shaft connected to a head at one end of said shaft, each of the heads having a hitting face for hitting a golf ball, said hitting face being inclined to define a loft angle, each of the clubs of the set having said loft angle selected from the range of 9° to 50°, the loft angle of each of the clubs in the set being different and increasing within said first, second and third groups, each of the clubs having a shaft length decreasing from club to club as the loft angle increases from club to club, each of the heads having a center of gravity a distance Z from the hitting face and located within the head, the distance Z decreasing from club to club as the loft angle increases from club to club, each golf club head of the first group of golf clubs having a loft angle selected in the range of from 9° to 25°, each golf club head of the first group of clubs being constructed with a sole plate attached to a first group shell molded of a synthetic resin, a filled cavity formed within the first group shell, each golf club head of the second group of golf clubs having a loft angle selected in the range of from 22° to 31° and being constructed with a seconnd group shell of a synthetic resin, a filled cavity formed within the second group shell and a sole plate integrally molded with the second group shell, and each golf club head of the third group of golf clubs having a loft angle selected in the range of from 28° to 50° and being constructed with a solid means of synthetic resin having a relatively high specific gravity as compared to the synthetic resin of the first group shell and the second group shell, and a sole plate integrally molded with the solid mass of synthetic resin.

2. A golf club set according to claim 1, in which each filled cavity is made of a light-weight synthetic resin of less than 0.6 in specific gravity, each first group shell and second group shell containing a reinforcing fiber.

3. A golf club set according to claim 1, said high specific gravity resin containing a reinforcing fiber and a high specific gravity powder such as a metal powder.

* * * * *